United States Patent [19]

Nottingham et al.

[11] Patent Number: 4,606,361

[45] Date of Patent: Aug. 19, 1986

[54] COIN SORTING BANK

[76] Inventors: John R. Nottingham, 60 Stonewood Dr.; John W. Spirk, Jr., 50 Stonewood Dr., both of Moreland Hills, Ohio 44022

[21] Appl. No.: 630,883

[22] Filed: Jul. 13, 1984

[51] Int. Cl.[4] ..... G07D 3/00

[52] U.S. Cl. ..... 133/3 R; 133/3 E

[58] Field of Search ..... 133/3 R, 3 E, 3 C, 3 D, 133/3 B, 3 H; 194/99, 102, 103, 97 R; 446/9

[56] References Cited

U.S. PATENT DOCUMENTS

| | | | |
|---|---|---|---|
| 2,118,425 | 5/1938 | Bibicos | 194/103 |
| 2,580,906 | 1/1952 | Frost | 133/3 X |
| 3,266,611 | 8/1966 | Kovar | 194/103 |

FOREIGN PATENT DOCUMENTS

| | | | |
|---|---|---|---|
| 766196 | 1/1957 | United Kingdom | 194/102 |

*Primary Examiner*—Joseph J. Rolla
*Assistant Examiner*—Edward S. Ammeen
*Attorney, Agent, or Firm*—Renner, Otto, Boisselle & Lyon

[57] ABSTRACT

A coin sorting bank that sorts coins according to their diameters, and also provides a unique form of animation when a coin is deposited therein. A coin deposited in the bank moves under gravitational/inertial forces from an inlet to a coin storage area. As it moves between the inlet and the coin storage area, the coin is engaged by a sorting mechanism comprising a unique arrangement of ramps, wheels, levers and guide rails which directs the coin to a respective coin bin in the coin storage area. A particular feature of the invention is a part of the sorting mechanism comprising a pivotal ramp and a stop member associated with the ramp. The structure provides effective sorting between coins of different diameters, and also provides a way of readily changing the bank to sort coins of different currencies by simply changing the location of the stop member relative to the pivotal ramp. The movement of the various elements of the sorting mechanism can be viewed by a user, and provides an animated image as a coin is being sorted.

12 Claims, 15 Drawing Figures

COIN SORTING BANK

The present invention relates to a coin sorting bank and more particularly to a coin sorting bank which has a unique assembly of ramps, wheels, levers and guide rails which effect sorting of different diameter coins into respective coin storage bins.

BACKGROUND

Numerous types of toy banks have been developed to entertain and fascinate both children and adults when a coin is deposited into the bank. Such banks have included levers, wheels, toggles, ramps, etc., that are engaged by a coin deposited into the bank to direct the coin to a respective coin storage bin, and also to generate an element of animation to provide enjoyment, entertainment, etc. The smallest diameter coins (e.g. a dime in U.S. currency) would be sorted in one coin storage bin, and larger diameter coins would be sorted in other respective storage bins. A unique design for a bank which provides sorting and also animation is shown in the applicants' U.S. Pat. No. D270,868. In the bank of U.S. Pat. No. D270,868 sorting is primarily effected by a combination of rotatable wheels, pivotal ramps, levers, and static guide rails. The front wall of the bank is transparent, to allow the movement of the coin to be observed, thereby providing animation as the coin moves along the ramps and/or engages the various elements.

In the applicant's experience, banks that produce both animation and coin sorting can present complex design problems that must be addressed in order to properly effect both animation and sorting. One problem is the need to control the manner in which elements move to properly sort coins according to size. Other considerations that need to be addressed are how to achieve both animation and sorting in a relatively compact package, and how to provide unique enough animation to fascinate the user.

Yet another issue that has been recognized by the applicants in the construction of the bank of the present invention is the need to provide a coin sorting bank design that can be readily modified to handle coins of different currencies. The coin sorting bank of the present invention is essentially formed of molded plastic parts, and the issue has been how to design the parts to provide effective coin sorting and to provide for ready modification of the parts to handle coins of different currencies.

SUMMARY OF THE INVENTION

The present invention relates to a coin sorting bank which has a unique mechanism for sorting different size coins of one currency, and which can be readily modified to sort coins of another currency. In a bank according to the present invention a coin moves from an inlet toward a coin storage area under gravitational/inertial forces. As it moves toward the coin storage area, the coin engages a sorting mechanism that directs the coin toward a respective coin bin in the coin storage area. The sorting mechanism is designed so that, during molding, the positions of certain of its elements can be readily changed in order to produce a bank that can handle a different type of currency.

A coin sorting bank according to the invention comprises a housing having an inlet for receiving a coin in an upright orientation, a coin storage area comprising a plurality of coin bins disposed in the housing, and a sorting mechanism for directing different diameter coins to respective coin bins. The housing and the sorting mechanism cooperate to receive a coin from the inlet in an upright condition and to guide the coin by gravitational/inertial forces between the inlet and the coin storage area while maintaining the coin in the upright orientation.

The sorting mechanism includes several sorting structures, each including a sorting ramp pivotal relative to the housing. The sorting ramp has a surface for engaging a coin, and a stop member is fixed to the housing and spaced from the surface of the sorting ramp by a predetermined amount. The spacing between the surface of the sorting ramp and the stop member allows certain smaller diameter coins to move along the surface of the sorting ramp without being impeded by the stop member and causes other larger diameter coins to be impeded after they move a predetermined distance along the surface of the sorting ramp. The location of the pivot for the sorting ramp, the weight distribution of the sorting ramp, and the spacing between the surface of the sorting ramp and the stop member causes a coin that is not impeded by the stop member to move in one angular direction along the sorting ramp and reverses the angular direction of movement of a coin whose movement is impeded by the stop member.

A particular advantage of the foregoing sorting structure is that it can be readily modified to sort coins of different currencies. Specifically, the spacing between the stop member and the sorting ramp can be varied to vary the dimensions of the coins which can be sorted thereby. In the molded plastic bank of the preferred embodiment, the stop member is a pin molded at a certain location on one of the components of the bank's housing. The location of the pin can be readily changed in order to adapt the bank to handle coins of different currencies.

In the preferred embodiment, there are several sorting ramps, and a respective stop member associated with each sorting ramp. Also there are pivotal members associated with each sorting ramp, with each pivotal member being engaged by coins moving toward the associated sorting ramp. A pivotal member can pivot between a first position in which it directs the coins onto the associated sorting ramp and a second position in which it is spaced from the associated sorting ramp and cooperates with the sorting ramp to define a passageway for guiding coins that are impeded by the stop member along a predetermined path toward the coin storage area. The pivotal member is biased toward its second position, and is engaged by a coin to pivot the member toward its first position to direct the coin onto the associated sorting ramp.

Still further, according to the preferred embodiment a first pivotal lever engages a coin deposited into the bank's inlet and pivots to a position in which it directs the coin along a first angular direction. A pivotal member (e.g. a second ramp) receives a coin moving in the first angular direction and pivots to its second position to change the angular direction of the coin and to direct the coin along the second angular direction onto a third ramp which comprises a sorting ramp. The sorting ramp directs a coin that is not impeded by an associated stop member along a second angular direction and to a first sort wheel. The sorting ramp also directs a coin that is impeded by the stop member along a third angular direction and toward a second sort wheel. A pair of additional sorting ramps and respective stop members are associated with each of the sort wheels for effecting further sorting of coins that have been directed to the sort wheels. Also, respective pivotal flipper members are provided for engaging coins from the sort wheels and for directing the coins to the associated sorting ramp, the sorting ramps cooperating with their associated pivotal flipper members to define respective guide paths for coins whose movement along a sorting ramp is impeded by the stop member associated with the sorting ramp.

The further objects and advantages of the invention will become further apparent from the following detailed description taken with reference to the annexed drawings.

DETAILED DESCRIPTION OF THE DRAWINGS

DETAILED DESCRIPTION OF THE PREFERRED EMBODIMENT

As discussed above, the present invention preferably provides a coin sorting bank with a unique assembly of ramps, levers, wheels and guide rails that provides animation and effectively sorts different size coins. In a bank according to the invention a coin deposited into the bank is directed through a sorting mechanism and toward a coin storage area, under gravitational/inertial forces. The bank has a transparent front cover that allows movement of the elements of the sorting mechanism to be viewed therethrough, thereby providing animation during the sorting operation. The speed and the direction of movement of the coin is controlled in the sorting mechanism so that effective animation and also proper coin sorting is achieved.

The concepts of the present invention are particularly useful in designing a coin sorting bank for coins of different currencies. The following description explains the manner in which the principles of the present invention are used to form a bank for any one particular currency having four different diameter coins that are desired to be sorted. However, from that description, the manner in which the principles of the invention can be used to form a bank for another currency will be clear to those of ordinary skill in the art.

Figure 1:
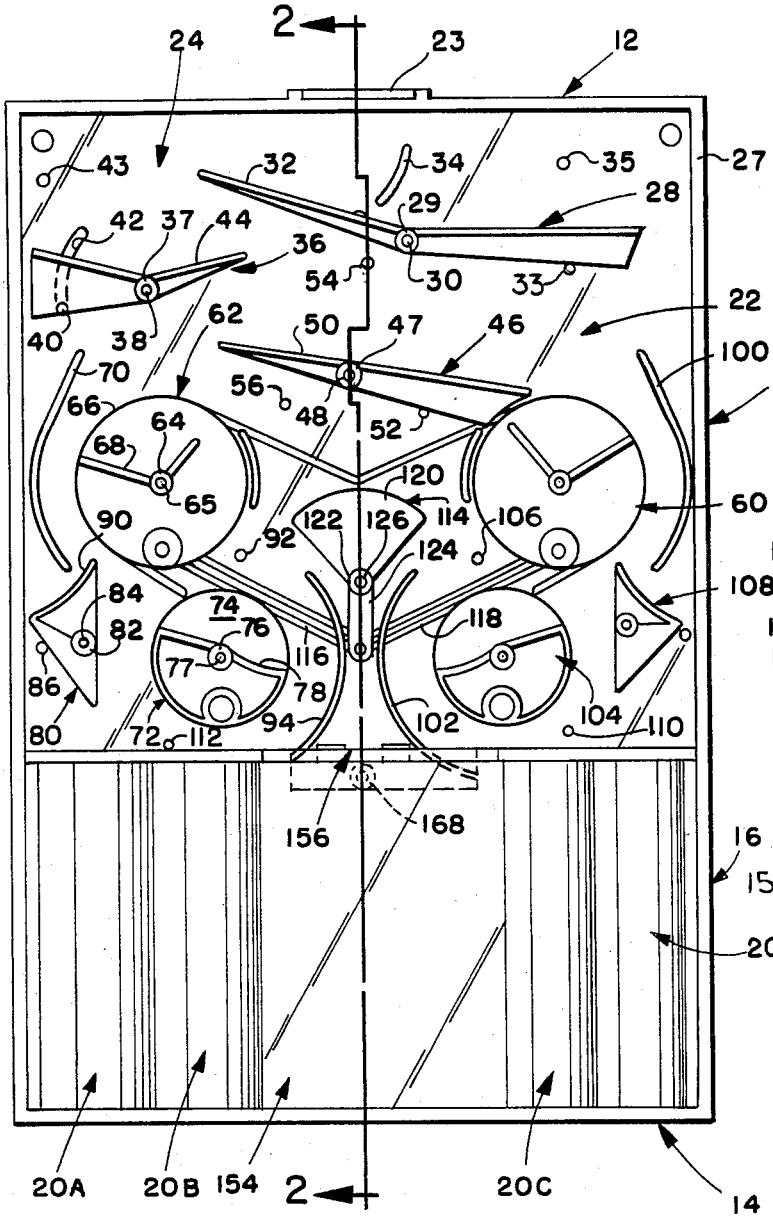
FIG. 1 is a front view of a coin sorting bank according to the invention, before a coin is deposited therein.

FIG. 1 schematically illustrates the overall configuration of a sorting bank 10 according to the principles of the invention. A generally upright housing 12 has a base portion 14 which is designed to rest on a support surface, with the housing 12 extending generally upward and upright from the support surface. The housing 12 comprises an upper portion 15 and a lower portion 16. The lower portion 16 includes the base portion 14, and a plurality of generally cylindrical coin storage bins 20(A–D), each for receiving a respective diameter coin. The upper portion 15 includes a sorting mechanism 22 comprising a unique arrangement of wheels, ramps, levels and guide rails which sorts coins according to their diameters and directs the coins to their respective coin storage bins.

In the upper portion 15 of the housing 12 there is an inlet 23 through which coins are deposited into the bank. The coins fall from the inlet into a sorting chamber 24 which includes the sorting mechanism 22. A coin deposited into the inlet 23 moves through the sorting chamber 24 under gravitational/inertial forces and is directed by the sorting mechanism to one of the respective coin storage bins 20(A–D).

Figure 2:
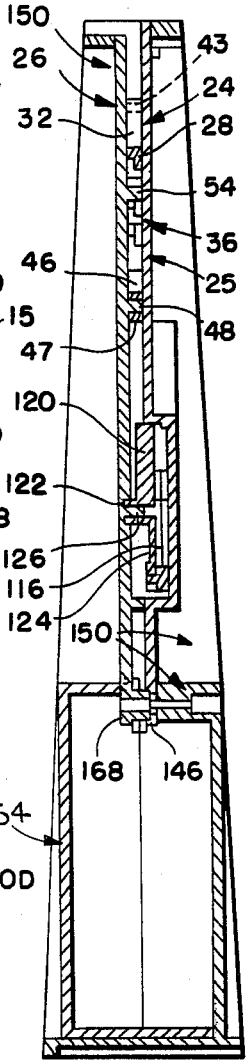
FIG. 2 is a sectional view of the bank of FIG. 1, taken from the direction 2-2 thereof.

Referring to FIGS. 1 and 2, the major components which define the sorting chamber 24 are a back wall 25, and a front cover 26 which is spaced from the back wall. Also, an intermediate side wall 27 (FIG. 1) extends transverse to the front cover 26 and the back wall 25. The space between the front cover 26, the back wall 25 and the intermediate side wall 27 is dimensioned to allow a coin to move therein in a generally upright orientation.

A coin deposited in the inlet 23 initially falls onto a pivotal first ramp 28. The ramp 28 has a hub 29 which is eccentrically mounted on a pivot pin 30 which is fixed relative to the housing. The hub 29 can pivot on the pin 30 to allow the first ramp 28 to pivot about the pin 30. The ramp 28 includes an upper surface 32 which engages the edge of a coin. A guide rail 34 fixed in the housing helps guide a coin deposited in the inlet 24 onto the upper surface 32. The first ramp 28 is biased toward the position shown in FIG. 1, and against a stop pin 33 fixed in the housing. When a coin falls onto the upper surface 32 it pivots the first ramp 28 counterclockwise about the pin 30 (from the position of FIG. 1) and allows the coin to roll downward at an inclined direction along the upper surface 32. Another stop pin 35 fixed to the housing limits the range of pivotal movement of the first ramp 28 in the counterclockwise direction.

In this application there are references to a coin moving in an inclined direction. The term "inclined direction" is intended to mean a direction extending at an incline to a vertical axis extending through the housing. Reference to the coin moving in a different inclined direction, or changing its inclined direction would mean that the coin still moves at an incline to the vertical, but in a direction which is also inclined relative to the prior direction of motion. For example, a coin moving at an incline toward the left in the bank shown in FIG. 3 would be moving in a first inclined direction. If the direction of the coin is changed so that the coin moves along an inclined path toward the right (i.e. the coin makes a zig-zag movement) the coin would now be moving at a different inclined direction.

Also, the sorting chamber 24 in the housing preferably extends vertically. A coin is deposited into the inlet 23 of the housing 12 in an upright orientation (with its edge leading) and the coin will assume an upright orientation conforming to the orientation of the sorting chamber 24 in the housing 12. In this application, reference to the coin moving while in an "upright orientation" is intended to mean that the coin is moving with its edge leading and with the major plane of the coin extending substantially vertically, to conform to the vertical orientation of the sorting chamber 24.

Below the upper ramp 28 there is an intermediate ramp 36. The intermediate ramp 36 has a hub 37 eccentrically mounted on a pin 38 that is fixed to the housing, so that the ramp 36 can pivot about the pin 38. Further, the intermediate ramp 36 includes a pin 40 that is fixed thereto and which is confined for movement in a slot 42 formed in the housing. The range of pivotal motion of the intermediate ramp 36 is limited by the length of the slot 42. Also, a dampener pin 43, fixed to the housing, is disposed toward the left end of the ramp 36 in FIG. 1.

Figure 3:
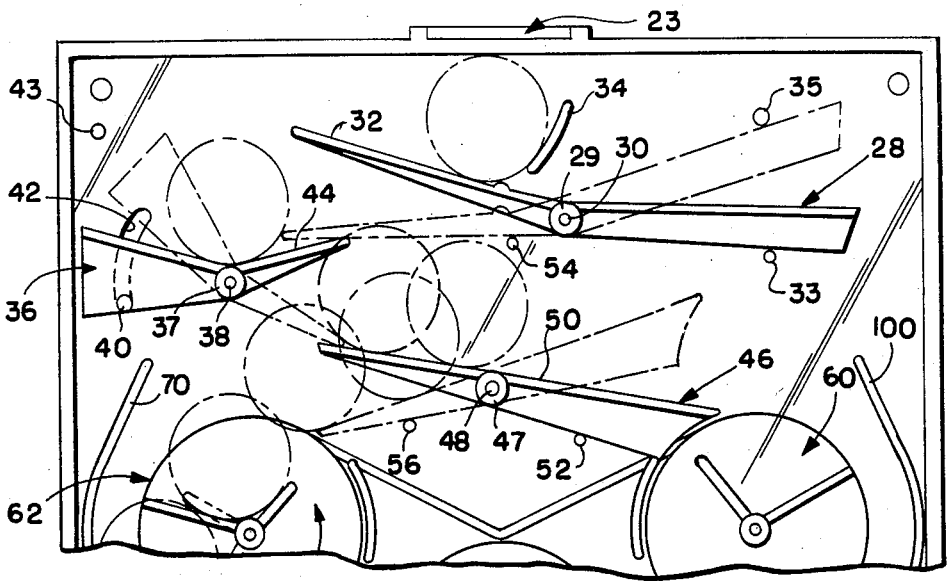
FIG. 3 is a schematic illustration of the movement of a certain diameter coin in the top portion of the bank of FIG. 1.
Figure 4:
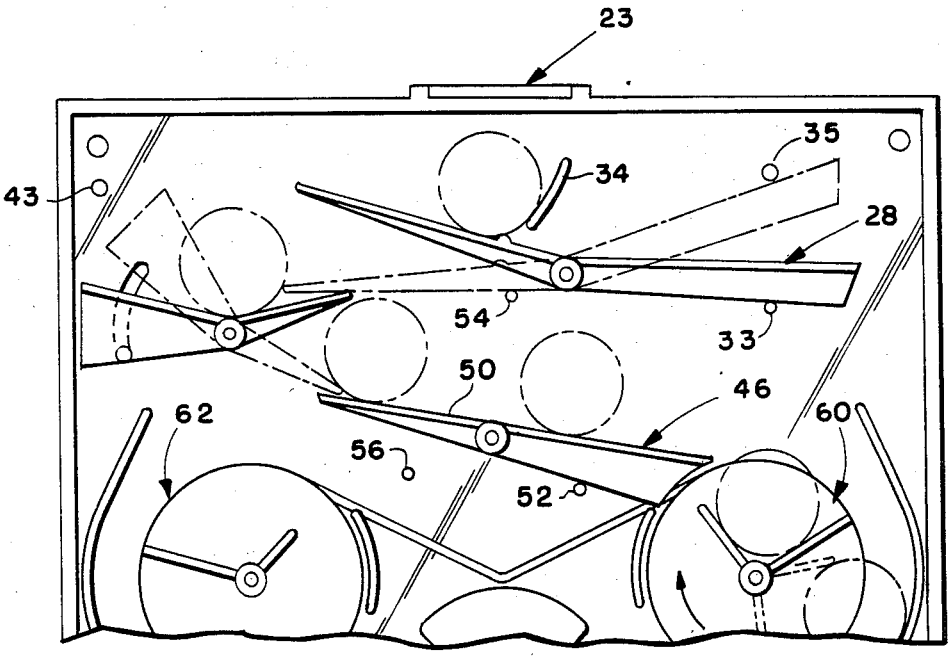
FIG. 4 is a schematic illustration of the movement of a different diameter coin in the top portion of the bank of FIG. 1.

A coin that rolls in a first inclined direction along the first ramp 28 rolls onto the intermediate ramp 36. FIGS. 3, 4 show in phantom lines the movement of the ramps 28, 36 and the path of movement of a coin along those ramps. The weight distribution of the intermediate ramp 36 is designed so that the intermediate ramp is biased under gravitational/inertial forces toward the position shown in FIG. 1 and in full lines in FIGS. 3, 4. When a coin moves onto the intermediate ramp 36, it reverses direction, engages a surface 44 on the intermediate ramp and pivots the intermediate ramp clockwise about the pivot pin 38. The coin is directed along a second inclined direction and onto an upper sort ramp 46. The upper sort ramp 46 has a hub 47 eccentrically supported for pivotal movement about a pivot pin 48 fixed in the housing (see FIG. 15). The upper sort ramp 46 includes an upper surface 50 which a coin can roll along in either angular direction. The weight distribution of the sort ramp 46 is such that the sort ramp 46 is biased toward the position of FIG. 1. A stop pin 52 fixed in the housing limits the range of pivotal movement of the sort ramp 46 in the clockwise direction.

Figure 15:
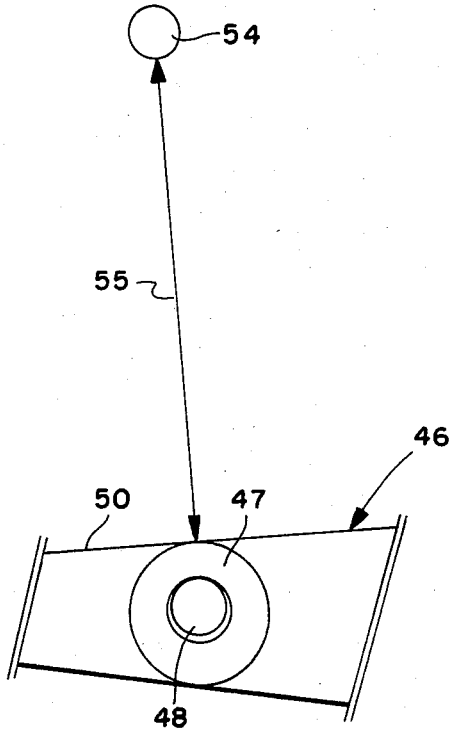
FIG. 15 is a schematic illustration of the pivotal support and associated stop member for one of the sorting ramps in the bank of FIG. 1.

According to a significant principle of this invention, a stop pin 54 is fixed in the housing and is spaced by a predetermined amount 55 from the portion of the surface 50 which pivots around the pin 48 (see particularly FIG. 15). The distance 55 is carefully selected so that certain smaller diameter coins can roll along the sort ramp 46 without being impeded by the stop pin 54, whereas larger diameter coins moving along the surface 50 will be impeded by the stop pin 54.

A smaller diameter coin deposited onto the upper sort ramp 46 will roll along the sort ramp and pass below the stop pin 54 (see FIG. 4). That coin maintains a moment on the sort ramp that is clockwise. Such a smaller diameter coin is then directed to a sorting wheel 60, described more fully hereinafter. A larger diameter coin deposited onto the upper sort ramp 46 is impeded by stop pin 54 (see FIG. 3). Such a larger diameter coin causes a counterclockwise moment to be applied to the upper sort ramp 46, and causes a reversal of the inclined direction of movement of the larger diameter coin (see FIG. 3). As the upper sort ramp 46 pivots counterclockwise, the direction of inclined movement of the larger diameter coin changes and the larger diameter coin is directed to another sort wheel 62, described more fully hereinafter. A stop pin 56 is fixed to the housing, and is disposed below the upper sort ramp 46, to limit the range of pivoting movement of the upper sort ramp 46 in the counterclockwise direction.

Significantly, when a larger diameter coin is impeded by the stop pin 54, and its direction of inclined movement is changed, the intermediate ramp 36 returns under gravitational/inertial forces to the position of FIG. 1. This occurs as the larger diameter coin is pivoting the upper sort ramp 46 counterclockwise toward the position shown in phantom in FIG. 3. A space is created between the intermediate ramp 36 and the upper sort ramp 46 forming a guide path that allows the movement of the larger diameter coin toward its respective sort wheel. The weight distribution of the intermediate ramp 36 and the upper sort ramp 46 are such that as a larger diameter coin moves the upper sort ramp 46 counterclockwise, the intermediate ramp 36 will quickly move clear of the coin and provide the path allowing the larger diameter coin to be directed to the sort wheel 62.

As indicated above, there are respective sort wheels 62, 60 for the larger and smaller diameter coins which leave the sort ramp 46. With most currencies, the bank of the invention would sort four different diameter coins, two larger diameter coins and two smaller diameter coins. The two smaller diameter coins would be directed to the sort wheel 60 disposed on one side of the sort ramp 46, and the two larger diameter coins would be directed to the sort wheel 62 on the other side of the sort ramp 46. The two different diameter coins directed to the respective sort wheels 60, 62 are then further sorted according to their respective diameters in a manner disclosed more fully hereinafter.

Figure 5:
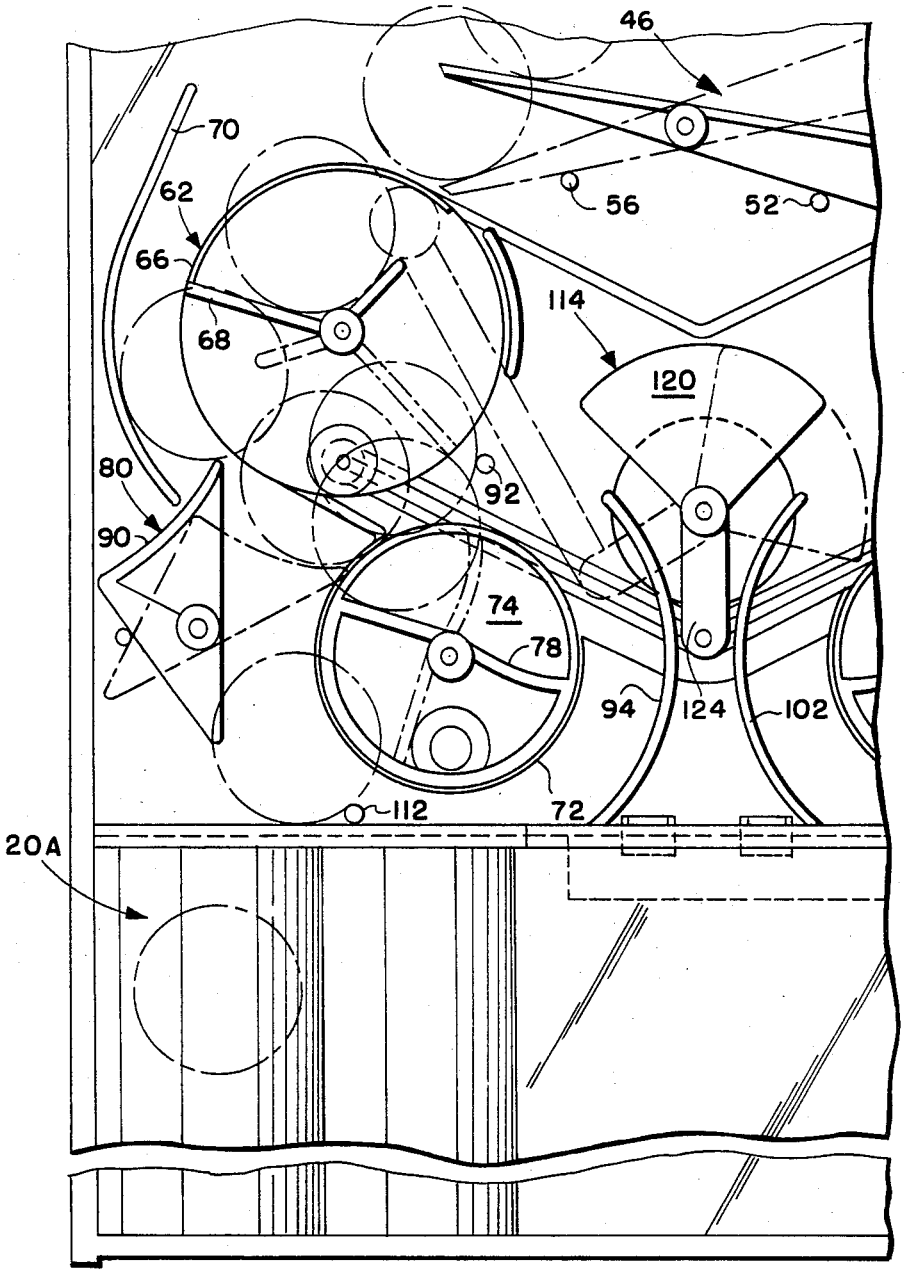
FIG. 5 is a schematic illustration of the movement of a coin in a lower portion of the sorting mechanism in the bank of FIG. 1.
Figure 6:
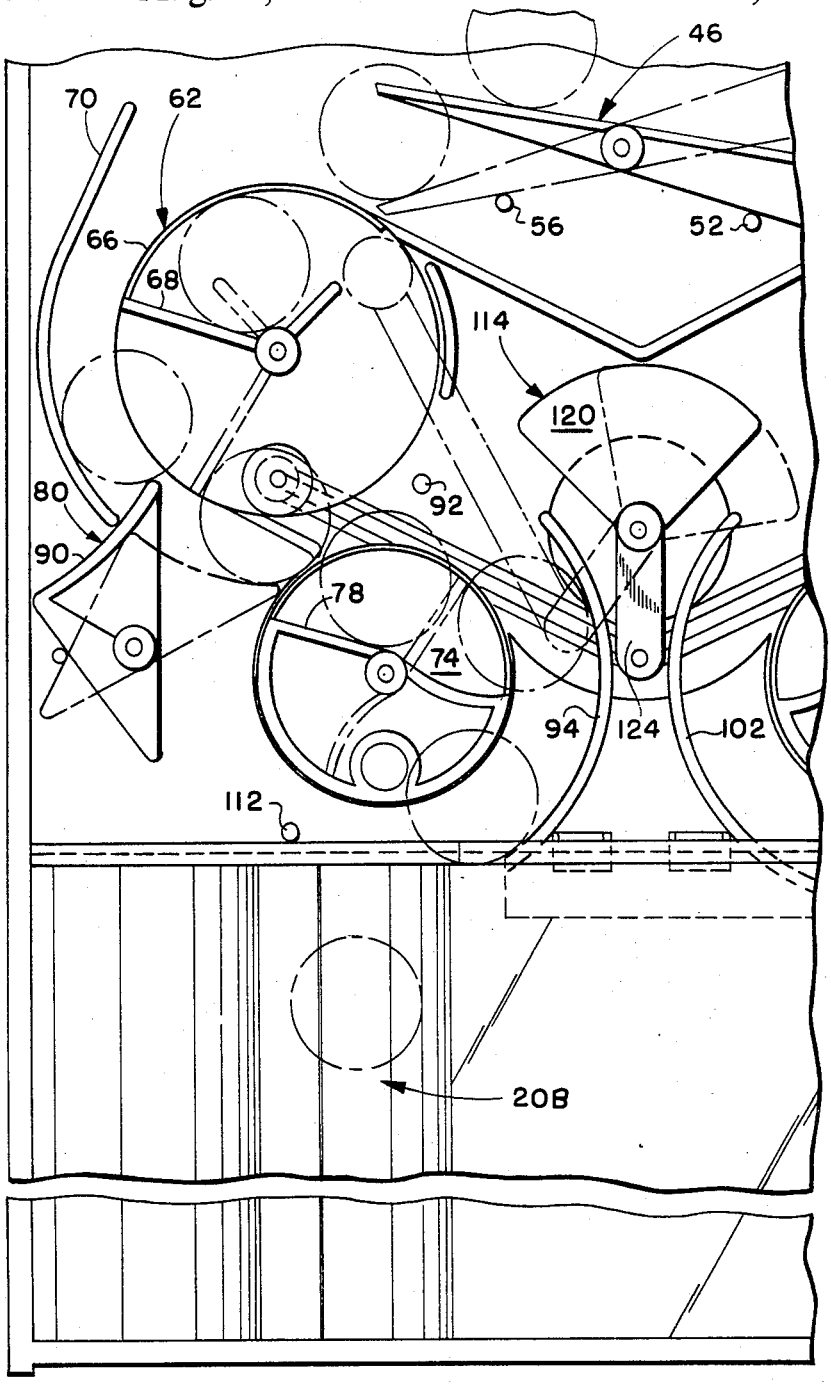
FIG. 6 is a schematic illustration of the movement of a different diameter coin in the same part of the sorting mechanism depicted by FIG. 5.

FIGS. 5 and 6 schematically illustrate how two different diameter coins are further sorted after they are directed to the sorting wheel 62. Specifically, the sorting wheel 62 has a hub 64 that encircles an axle 65 fixed to the housing, and supports the wheel 62 for rotation. The sorting wheel 62 has a circular outer peripheral surface 66, and a radially extending ledge 68 which is engaged by a coin directed to the sorting wheel 62. In addition, a guide rail 70 fixed in the housing has an arcuate curvature that is similar to the curvature of the outer periphery of the sort wheel 62. A coin directed to the sort wheel 62 initially engages the ledge 68 and begins to rotate the sort wheel 62. The coin is thrown radially outward by gravitational/inertial forces and engages the guide rail 70 and is guided thereby along an arcuate path.

A coin moving along the arcuate guide rail 70 toward the bottom of the sorting wheel is directed onto an associated sorting ramp (e.g. sorting ramp 72 in FIGS. 5, 6). The sorting ramp 72 comprises a wheel 74 with a hub 76 that encircles, and is pivotal on, an axle 77 fixed to the housing. The wheel 74 has a ramp surface 78 along which a coin can roll.

Significantly, as seen from FIG. 1, there is normally a space between the guide rail 70 and the sorting ramp 72. A pivotal lever, or flipper member, 80 is provided for bridging the space between the guide rail 70 and the sorting ramp 72 for guiding a coin from the guide rail 70 onto the surface 78 of the sorting ramp 72. The pivotal flipper member 80 has a hub 82 encircling a pin 84 that is fixed to the housing, and allows the flipper member 80 to pivot thereabout. The weight distribution of the flipper member 80 biases it toward the position shown in full lines in FIGS. 5, 6, and against a stop pin 86 fixed to the housing. The flipper member 80 has a curved surface 90 which intersects the path of movement of a coin leaving the guide rail 70. Normally, the flipper member 80 is biased against the stop pin 86, but can be pivoted toward the phantom line position of FIGS. 5, 6 when engaged by a coin moving off the guide rail 70. When the flipper member 80 is engaged by a coin, its curved surface 90 forms effectively a continuation of the curved path established by the guide rail 70, and guides the coin onto the associated sorting ramp 72.

A stop pin 92 is disposed above the surface 78 of sorting ramp 72. The stop pin 92 allows a smaller diameter coin to pass under the stop pin as it moves along the surface 78, and impedes movement of a larger diameter coin moving along surface 78. A smaller diameter coin passing under the stop pin 92 pivots the sorting ramp 62 clockwise in the illustration of FIG. 6. The coin will be thrown radially outward and will engage an arcuate guide rail 94 fixed to the housing. The coin is then directed by the guide rail 94 and the sorting ramp 72 into a respective coin bin 20B. A larger diameter coin is impeded by the stop pin 92 as it begins to move along the sorting ramp surface 78. Such a larger diameter coin exerts a counterclockwise moment on the sorting ramp 72 and allows the larger diameter coin to reverse its angular direction and move toward its respective storage bin 20A. The weighting of the flipper member 80 is such that as the larger diameter coin changes its angular direction the flipper member 80 is being returned toward its biased position in which it cooperates with the ramp surface 78 to define a guide path for allowing the larger diameter coin to move toward its respective coin bin 20A.

Of course, while the structure for sorting coins directed to sort wheel 62 has been described in detail above, it will be clear to those in the art that similar structure is provided for sorting coins directed to sort wheel 60. Specifically, referring to FIG. 1, there are guide rails 100, 102, a sorting ramp 104, a stop pin 106, and a flipper member 108 which function in a manner similar to the way such elements function in the description of FIGS. 5, 6, to sort coins directed to the sort wheel 60. Furthermore, there are coin deflection pins 110 and 112 fixed in the housing and disposed below the sort wheels 60, 62, respectively. The deflection pins 110, 112 further help guide the coins toward their respective coin bins.

A linkage comprising a counterweight 114 and a pair of levers 116, 118 is connected between the sort wheels 60, 62 (FIG. 1). The counterweight 114 includes a sector member 120, a hub 122 and an arm 124 that are molded together as a unitary member. The hub 122 is pivotally journaled on an axle 126 fixed in the housing. The levers 116, 118 are pivotally connected to the distal end of the arm 124, and each lever is pivotally connected to a respective sort wheel 60, 62. Thus, during sorting, when one sort wheel pivots, the elements of the linkage move, and cause the other sort wheel to pivot, thereby enhancing the animation provided by the bank. When a coin has been sorted, the counterweight 114 returns the linkage and the sort wheels to the position of FIG. 1. Also, the sorting ramps 72 and 104 are counterbalanced, so that after effecting sorting, they are returned to the position of FIG. 1.

A significant aspect of this invention resides in the fact that each sorting ramp (e.g. 46, 72, 104) is separate from the stop pin associated with that ramp. Such structure allows a ready modification of the bank for handling different currencies. As an example, it may only be necessary to change the location of some of the stop pins (e.g. 54, 92, 106) and possibly the deflector pins 110, 112 to change the bank from a sorting bank for one currency to a sorting bank for another currency. The bank parts are all molded of plastic, and the location of the stop pins and deflector pins can be readily changed by appropriate mold inserts. Thus, the invention provides a structural arrangement of parts that provide for ready construction of molded plastic banks which can sort coins of different currencies.

The back wall 25 is a molded plastic member whose profile is shown in FIGS. 10–14. The profile of the back wall which faces the inside of the sorting chamber includes a flat surface 130, and a butterfly-shaped profile 132 which is recessed relative to surface 130. The profile 132 accommodates the sorting wheels 60, 62 and the linkage extending between the sorting wheels 60, 62. A stepped ridge 134 extends partly around the recessed area 132 and includes protruding members 136 which space the sort wheels 60, 62 from continuous engagement with surfaces of the back wall to reduce friction. A hole 138 extends through the recessed portion to allow access to the interior of the bank. Also, the back wall has several locator holes (e.g. 140, 142, 144) which help locate properly the back wall in the housing. Finally, the back wall has a hole 146 (FIGS. 10, 14) which is engaged by a locking screw to help lock the back wall in the housing.

The back wall 25 is disposed in a housing member 150 that is also a molded plastic member. The lower portion of the housing member 150 has parts of the cylindrical coin bins 20(A–D) molded therein. The other parts of the cylindrical coin bins 20(A–D) are formed in a front coin drawer member 154 which is pivotally connected to the housing member 150. The pivotal front coin drawer member 154 comprises a plastic member with a pair of pivot pins (not shown) at its lower end. The pivot pins can engage respective holes in the housing member 150 to provide a pivotal connection between the front coin drawer member 154 and the housing member 150. At its top end, the pivotal coin drawer member 154 includes a resiliently deflectable latch means 156 (FIG. 1). The latch means 156 can have a locking engagement with the inside of the front cover 26 to retain the coin drawer member in a closed position (FIG. 1). Downward pressure on the latch 156 releases the latch from engagement from the inside of the front wall 26 and allows the coin drawer member 154 to be pivoted forwardly, thereby allowing coins to be removed when the coin bins 20(A–D) are filled.

Figure 9:
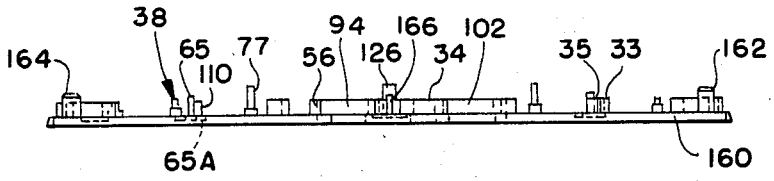
FIG. 9 is a top view of the front cover shown in FIG. 7.
Figure 7:
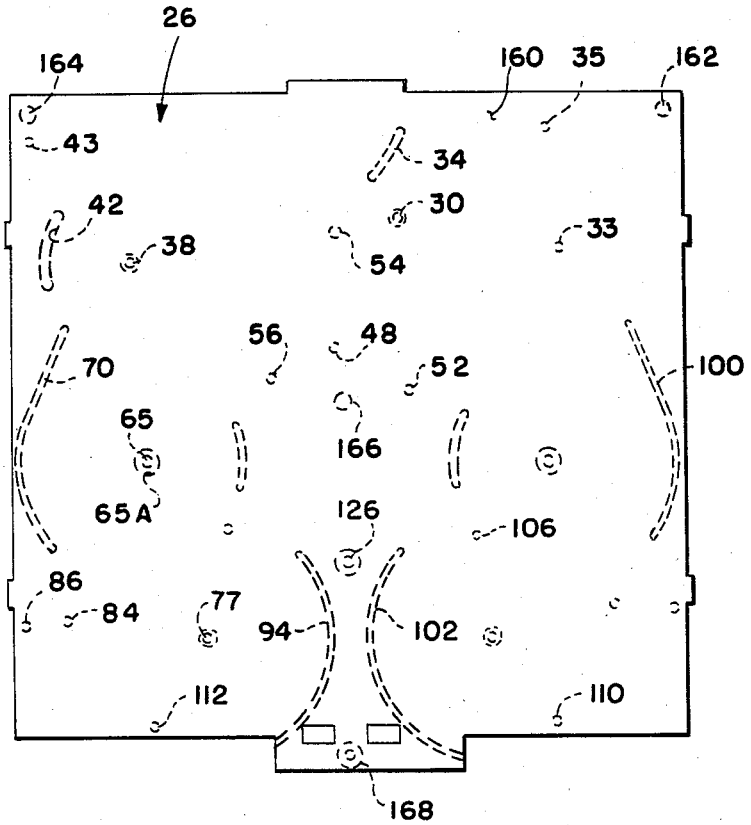
FIG. 7 is a front plan view of the front cover for the bank of FIG. 1.
Figure 8:
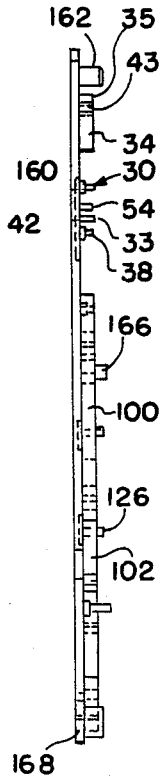
FIG. 8 is a right side elevational view of the front cover shown in FIG. 7.
Figure 12:
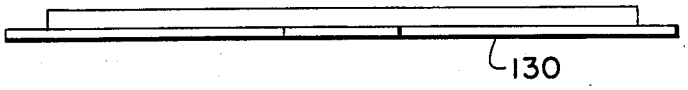
FIG. 12 is a top view of the back wall of FIG. 10.
Figure 10:
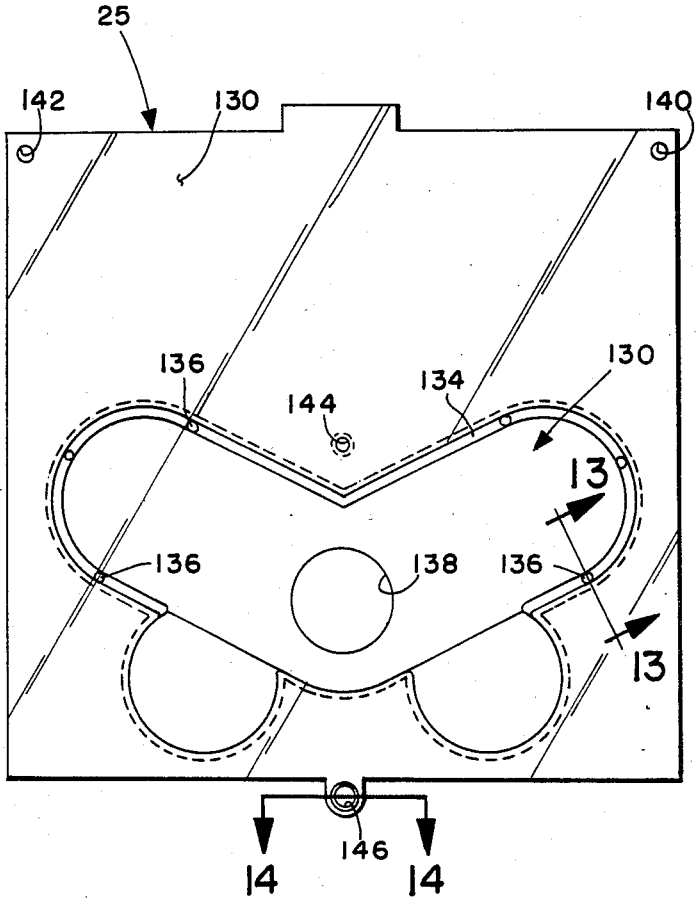
FIG. 10 is a plan view of the back wall of the bank, taken from a direction facing the side of the back wall that forms the inside of the bank.
Figure 11:
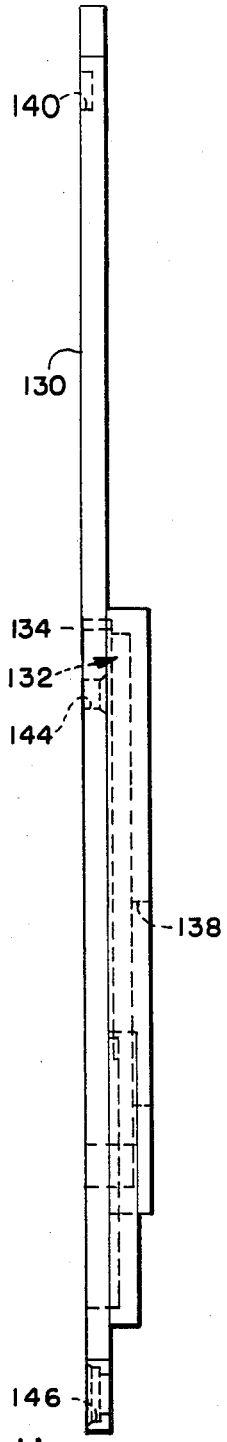
FIG. 11 is a right side elevational view of the back wall shown in FIG. 10, on an enlarged scale.
Figure 13:
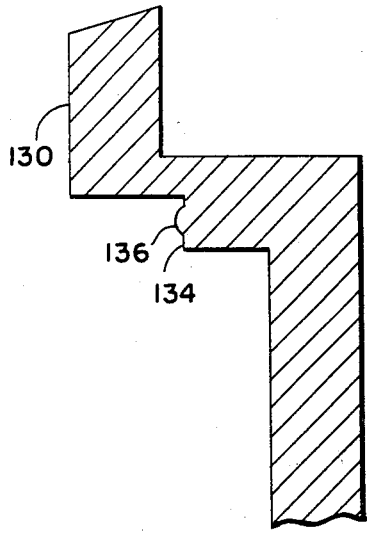
FIG. 13 is a sectional view of the back wall of FIG. 10, taken from the direction 13—13 thereof.
Figure 14:
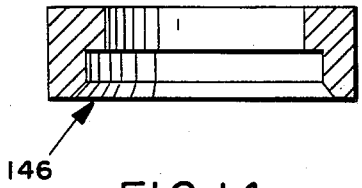
FIG. 14 is a sectional view of the back wall of FIG. 10, taken from the direction 14—14 thereof.

The front cover 26 is a molded plastic member. Its profile is depicted in FIGS. 7–9. Specifically, the front cover has a planar wall 160, and the stop pins (e.g. 33, 52, 56, 86), fixed pivot pins and axles (e.g. 30, 38, 48, 65, 84, 77, 126), recess 42 and guide rails (e.g. 34, 70, 100) are integrally molded with the planar wall portion, and extend out of the plane of the wall portion 160. The sort wheel and counterweight axles (e.g. 65) are surrounded by respective recesses (e.g. 65A). Also, several locator pins 162, 164, 166 are molded into the front cover 26 and are designed for mating engagement with the locator holes 140, 142, 144 in the back wall 25. Further, the front cover 26 includes a portion 168 designed to matingly engage the member 148 in the back wall 25, and the portion 168 includes an opening which can receive a locking screw which locks those members together.

As can be seen from the foregoing disclosure, the principles of this invention can be readily applied to construct an animated bank for sorting a particular currency. Also, the design of the bank is such that it can be readily constructed for coins of different currencies. For example, the locations of the stop pins and the deflector pins on the front cover 26 may be changed to construct a bank which accommodates a different currency. The locations of such elements on the molded front cover 26 are readily changed by the use of appropriate mold inserts.

Preferably, the elements of the bank are molded of clear or tinted, transparent plastic so that the movement of the coins is visible therein. In the display area, the movement of the coins provides an additional element of animation as the coins are being sorted. The transparency in the lower portion of the bank allows the person using the bank to see how full the coin bins are, so that it is easy to determine when the coins need to be removed.

It is believed that with the foregoing description in mind many and varied obvious modifications using the principles of this invention will become apparent to those of ordinary skill in the art.

We claim:

1. A coin sorting bank comprising a housing having an inlet for receiving a coin in an upright orientation, a coin storage area comprising a plurality of coin bins disposed in said housing, each of said coin bins being dimensioned to receive a different diameter coin, and a sorting mechanism for directing different diameter coins to respective coin bins; said housing and said sorting mechanism cooperating to receive a coin from said inlet in an upright orientation and to guide said coin by gravitational/inertial forces between said inlet and said coin storage area while maintaining the coin in the upright orientation throughout its passage toward said coin bins said sorting mechanism including a pivotal sorting ramp supported in the housing; the pivotal sorting ramp having a pivot and a surface for engaging a coin moving between the inlet and the coin storage area; said pivot being located intermediate the ends of the surface of the pivotal sorting ramp; and a stop member fixed to the housing and spaced from the surface of the sorting ramp by a predetermined amount; the sorting ramp being biased in a direction that causes coins disposed thereon to move toward one end of the surface of the pivotal sorting ramp; the spacing between the surface of the sorting ramp and the stop member being great enough to allow certain diameter coins to move along the surface of the sorting ramp toward said one end of the sorting ramp without being impeded by said stop member and being close enough to the surface of the sorting ramp to impede other diameter coins after such coins have moved a distance along the surface of the sorting ramp; the sorting ramp being pivotal against its bias by a coin that is impeded by said stop member toa position in which such a coin reverses direction on said surface of said sorting ramp and moves toward the other end of the surface of the sorting ramp; the coins directed toward different ends of the surface of the sorting ramp moving along different paths toward said coin storage area.

2. A coin sorting bank as defined in claim 1 wherein said housing includes a back wall and a front cover spaced from said back wall, said sorting ramp being disposed at least partially between said front cover and said back wall, a coin moving between said front cover and said back wall in an upright condition as it moves along said surface of said sorting ramp, and said stop member being disposed at least partially between said front cover and said back wall so that a coin moving in an upright orientation between the front cover and the back wall can engage said stop member as it moves along said surface of said sorting ramp.

3. A coin sorting bank comprising a housing having an inlet for receiving a coin in an upright orientation, a coin storage area comprising a plurality of coin bins disposed in said housing, each of said coin bins being dimensioned to receive a different diameter coin, and a sorting mechanism for directing different diameter coins to respective coin bins; said housing and said sorting mechanism cooperating to receive a coin from said inlet in an upright orientation and to guide said coin by gravitational/inertial forces between said inlet and said coin storage area while maintaining the coin in the upright orientation throughout its passage toward said coin bins, said sorting mechanism including a pivotal sorting ramp supported in the housing, the pivotal sorting ramp having a surface for engaging a coin moving between the inlet and the coin storage area, and a stop member fixed to the housing and spaced from the surface of the sorting ramp by a predetermined amount; the spacing between the surface of the sorting ramp and the stop member allowing certain diameter coins to move along the surface of the sorting ramp without being impeded by said stop member and causing other diameter coins to be impeded after moving a predetermined distance along the surface of the sorting ramp; the spacing between the surface of the sorting ramp and the stop member causing a coin that is not impeded by the stop member to move primarily in one direction along said sorting ramp and causing a coin that is impeded by said stop member to reverse direction on said sorting ramp, the sorting mechanism directing the different diameter coins along different paths toward said coin storage area; said housing including a back wall and a front cover spaced from said back wall, said sorting ramp being disposed at least partially between said front cover and said back wall, a coin moving between said front cover and said back wall in an upright condition as it moves along said surface of said sorting ramp; and said stop member being disposed at least partially between said front cover and said back wall so that a coin moving in an upright orientation between the front cover and the back wall can engage said stop member as it moves along said surface of said sorting ramp; the sorting mechanism comprising a pivotal member which is engaged by a coin moving toward said sorting ramp; said pivotal member being pivotal between a first position in which it directs coins onto said sorting ramp and a second position in which it cooperates with said sorting ramp to define a passageway for guiding a coin that is impeded by said stop member along a predetermined path toward said storage area.

4. A coin sorting bank as set forth in claim 3 wherein said pivotal member is biased toward said second position, said pivotal member when in said second position being disposed in the path of movement of coins moving toward said sorting ramp and being pivotal toward said first position by engagement with coins moving toward said sorting ramp.

5. A coin sorting bank as set forth in claim 4 wherein said sorting mechanism includes a sorting wheel supported for rotation about a fixed axis, guide means for directing coins along an arcuate path in which they engage said sorting wheel and rotate said sorting wheel, a coin being released from engagement with said guide means and said sorting wheel after imparting rotation to said sorting wheel, said sorting ramp being disposed in spaced relation to the point at which a coin is released from said guide means, and said pivotal member being engaged by a coin at the end of said guide means and being pivotal toward its first position to bridge the space between said sorting ramp and the point at which a coin is relased from engagement with said guide means.

6. A coin sorting bank as set forth in claim 5 wherein said guide means comprises an arcuate wall fixed to said housing, said pivotal member comprising an arcuate surface that forms a continuation of said wall when said pivotal member is moved to its first position.

7. A coin sorting bank as set forth in claim 4 wherein said bank includes a first pivotal lever that engages a coin deposited into said inlet and pivots to a position in which it directs the coin along a first angular direction to said pivotal member, said pivotal member being biased to its second position to receive a coin moving in said first angular direction and being adapted to pivot to its first position to change the angular direction of the coin and to direct the coin along said second angular direction onto said sorting ramp.

8. A coin sorting bank as set forth in claim 7 wherein said sorting ramp directs coins that are not impeded by said stop member along said second angular direction and to a first sort wheel, and said sorting ramp pivots to a position in which it directs coins that are impeded by said stop member along a third angular direction and toward a second sort wheel.

9. A coin sorting bank as set forth in claim 8 wherein additional sorting ramps and respective stop members are associated with each of said sorting wheels for effecting further sorting of coins that have been directed to said sorting wheels, and additional pivotal members are provided for engaging coins directs to said sorting wheels and for directing the coins to the associated additional sorting ramp, each additional sorting ramp cooperating with its associated pivotal member to define a guide path for coins whose movement along the respective sorting ramp is impeded by the stop member associated with the sorting ramp.

10. A coin sorting bank as set forth in claim 9 wherein said additional sorting ramps each comprise a rotatable wheel disposed adjacent to the respective first or second sort wheel.

11. A coin sorting bank as set forth in claim 10 wherein the housing of said bank comprises molded plastic elements defining said sorting mechanism.

12. A coin sorting bank as set forth in claim 11 wherein said front cover is transparent so that the movement of a coin between the inlet and the coin storage area can be viewed therethrough.

* * * * *